United States Patent [19]

Fantuzzo et al.

[11] Patent Number: 4,589,759

[45] Date of Patent: May 20, 1986

[54] REPRODUCING APPARATUS WITH OPTIC SCANNING MODULE

[75] Inventors: Joseph Fantuzzo, Webster; Edwin R. Monkelbaan, Fairport; Henry R. Till, Rochester, all of N.Y.

[73] Assignee: Xerox Corporation, Stamford, Conn.

[21] Appl. No.: 645,891

[22] Filed: Aug. 31, 1984

[51] Int. Cl.[4] ..... G03G 15/00

[52] U.S. Cl. ..... 355/8; 355/3 SH

[58] Field of Search ..... 355/8, 3 BE, 16, 51, 355/66, 3 SH

[56] References Cited

U.S. PATENT DOCUMENTS

| | | | |
|---|---|---|---|
| 2,825,814 | 3/1958 | Walkup | 250/49.5 |
| 2,833,648 | 5/1958 | Walkup | 96/1 |
| 2,937,943 | 5/1960 | Walkup | 96/1 |
| 2,975,052 | 3/1961 | Fotland et al. | 96/1 |
| 3,574,455 | 4/1971 | Mix, Jr. et al. | 355/3 |
| 3,637,302 | 1/1972 | Hunt et al. | 355/8 |
| 3,637,306 | 1/1972 | Cooper | 355/15 |
| 3,647,293 | 3/1972 | Queener | 355/15 |
| 3,658,407 | 4/1972 | Kitano et al. | 350/96 B |
| 3,752,571 | 8/1973 | Yamaguchi et al. | 355/16 X |
| 3,754,822 | 8/1973 | Melrose | 355/50 X |
| 3,771,866 | 11/1973 | Ogawa | 355/3 |
| 3,843,252 | 10/1974 | Tanaka et al. | 355/16 |
| 3,867,027 | 2/1975 | Weigl | 355/8 |
| 3,947,106 | 3/1976 | Hamaguchi et al. | 355/1 |
| 3,977,777 | 8/1976 | Tanaka et al. | 355/1 |
| 4,068,936 | 1/1978 | Kushima et al. | 355/1 |
| 4,087,170 | 5/1978 | Sawaoka et al. | 355/3 CH |
| 4,116,557 | 9/1978 | Kushima et al. | 355/8 |
| 4,129,373 | 12/1978 | Ogura et al. | 355/1 |
| 4,364,656 | 12/1982 | Yanagawa | 355/3 CH |
| 4,372,669 | 2/1983 | Fantuzzo et al. | 355/3 R |

*Primary Examiner*—A. T. Grimley
*Assistant Examiner*—J. Pendegrass
*Attorney, Agent, or Firm*—Samuel E. Mott, III

[57] ABSTRACT

An electrostatographic reproducing apparatus of the two cycle variety wherein a photoconductive belt is arranged to move in a recirculating path, includes a transparent viewing platen together with an optical scanning module positioned between the viewing platen and the photoconductive belt for scanning the viewing platen which includes copy sheet registration rolls which capture the lead edge of a copy sheet at the end of scan position returning the copy sheet to the transfer position near the beginning of scan position to feed the copy sheet in timed relation to the lead edge of the developed toner image on the photoconductive belt where the belt is supported by a support roll thereby providing a short transfer zone.

14 Claims, 6 Drawing Figures

REPRODUCING APPARATUS WITH OPTIC SCANNING MODULE

CROSS REFERENCE TO RELATED APPLICATIONS

Attention is directed to copending application Ser. No. 126,586, entitled Reproducing Machine, filed Mar. 3, 1980 in the name of Gilbert A. Aser.

BACKGROUND OF THE INVENTION

This invention relates generally to an electrostatographic reproducing machine for reproducing an original document on a copy sheet. More particularly, the reproducing machine of the present invention is a two cycle machine with an optical scanning module containing a copy sheet delivery mechanism.

Generally, in the process of electrophotographic printing, a photoconductive member is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After recording the electrostatic latent image on the photoconductive member, the latent image is developed by bringing a developer material comprising carrier granules having toner particles adhering triboelectrically thereto into contact therewith. The toner particles are attracted from the carrier granules to the electrostatic latent image to form a toner powder image which is subsequently transferred to a copy sheet. Thereafter, the toner powder image is permanently affixed to the copy sheet in image configuration.

Generally, the various stations for charging, exposing, developing, transferring, cleaning, and discharging are separate units disposed about the photoconductive member. The complexity and associate cost of the reproducing machine may be significantly reduced if the various separate units are combined to perform dual functions. Hereinbefore, various attempts have been made to achieve the foregoing. In particular, various combination units have been devised for electrophotographing printing machines employing photoconductive drums.

PRIOR ART

U.S. Pat. No. 3,637,306 (Cooper) discloses an electrophotographic printing machine employing a combined developing/cleaning unit which is operable to perform either function at the proper time during the copying sequence. This unit is a magnetic brush developer unit that serves both as a developer and cleaner in the system.

U.S. Pat. No. 3,647,293 (Queener) also describes a combined developing cleaning unit wherein the magnetic brush developer unit serves both as developer and cleaner in the system. In the developing mode, toner particles are attracted from the carrier granules of the unit to the photoconductive layer. When used in the cleaning mode, the brush rotates and the developer mixture is brushed against the photoconductive layer to scavenge residual toner particles remaining thereon.

U.S. Pat. No. 4,087,170 (Sawaoka et al.) discloses an electrostatic copying machine having a rotatable photoconductive drum. The machine includes charge/transfer, exposure/discharge, and developer/clean units. During the first rotation of the drum, charge, exposure and development are affected. In the second rotation, transfer, discharge and cleaning are achieved. The charge/transfer unit performs the functions of charging and transferring with the expose/discharge unit exposing and discharging and the development/clean unit performing development and cleaning.

U.S. Pat. No. 4,372,669 (Fantuzzo et al.) describes a similar type of apparatus wherein instead of a photoconductive drum being used for the imaging surface, a photoconductive belt is arranged to move in a recirculating path.

The devices described above and particularly U.S. Pat. No. 4,372,669 (Fantuzzo et al.) enable the economy of manufacturing by combining two functions in the same functional apparatus around the imaging surface. In addition Fantuzzo et al., enables the use of a top paper path thereby moving the copy sheet paper from the most dirt contaminated portion of the machine (where the developer and cleaner housings are) and enabling the production of reproduction copies which minimize background or other contamination caused by dirt. The device described in Fantuzzo et al. however does suffer from the following deficiencies. Since it is a moving platen device it is very difficult to increase to any substantial degree the copy rate without increasing the platen speed. If the platen speed is increased in the reproduction of massive documents such as dictionaries and other large books the inertia of the platen during its scanning operation becomes excessive requiring heavier duty mechanical components in the platen scanning mechanism thereby contributing to increased cost. Furthermore if the scanning platen moves too fast, this is perceived by the operator as being an unsafe condition and therefore the operators become reluctant to use the machine. Accordingly there is a desire to increase the copy rate of a machine such as that described in the Fantuzzo et al. U.S. Pat. No. 4,372,669 without increasing the platen scan speed. Furthermore the Fantuzzo et al. apparatus, provides for a relatively long transfer zone wherein the copy sheet paper is in contact with the photoconductive belt for a large portion of its travel. This may lead to the electrostatic charge on the photoconductive belt bleeding off onto the copy paper thereby reducing transfer efficiency and reduced image density in the copies produced. Accordingly there is a desire to provide a short transfer zone in such a reproducing apparatus.

SUMMARY OF THE INVENTION

In accordance with the present invention an electrostatographic reproducing apparatus of the type using a photoconductive belt which completes two cycles for each copy produced and includes a transparent viewing platen is provided with an optical scanning module positioned between the viewing platen and the photoconductive belt, with the optical scanning module including copy sheet registration rolls which capture individual copy sheets fed from a sheet feeder at the end of scan position and returns the copy sheet on the rescan of the optical scanning module to a transfer position near the start of scan position wherein the lead edge of a copy sheet is fed in timed relation to the lead edge of the developed toner image on the photoconductive belt to transfer toner image to the copy sheet.

In a specific aspect of the present invention, the photoconductive belt has a portion of its path spaced from and parallel to the viewing platen.

In a further aspect of the present invention, the optical scanning module includes a combined charging/-transfer corona generating device for uniformly charging the photoconductive belt during the first cycle, prior to imaging, and to electrostatically transfer the charged toner particles in the developed image on the belt to the copy sheet during the second cycle.

In a further aspect of the present invention, said photoconductive belt is supported between two support rolls, one each near the start of scan and end of scan positions, and wherein the copy sheet is fed into timed relation with the photoconductive belt with the toner image thereon to transfer the toner around the belt support roll near the start of scan position thereby providing a short toner transfer zone.

In a further aspect of the present invention, the optical scanning module includes an illuminating source to illuminate a document on the viewing platen and means to focus a light image of the original onto the charged portion of the photoconductive belt, with the focusing means corona generating device and copy sheet registration rolls, being arranged in that order in the optical scanning module from in the scanning direction.

In a further aspect of the present invention, means are provided to move the viewing platen and the photoconductive belt as the optical scanning module scans the viewing platen. A specific aspect of this feature involves the optical module scanning in the scanning direction at a given speed while the platen moves in the direction opposite the scanning direction at the same given speed with the photoconductive belt moving in a direction opposite the scanning direction at twice the given speed to enable the imaging platen and the photoconductive belt to not move relative to one another during imaging.

In a further aspect of the present invention, a combination developing/cleaning unit is provided wherein an electrostatic latent image is developed during the first cycle of the belt through the combination unit and residual charged toner remaining after transfer of the toner image to the copy sheet is cleaned during the second cycle.

In a further aspect of the present invention, an electrostatographic reproducing apparatus with increased copy rate output is provided without increasing platen scan speed.

In a further aspect of the present invention, an electrostatographic reproducing apparatus is provided with a relatively short transfer zone which maximizes transfer efficiency.

DESCRIPTION OF THE PREFERRED EMBODIMENT

Figure 1:
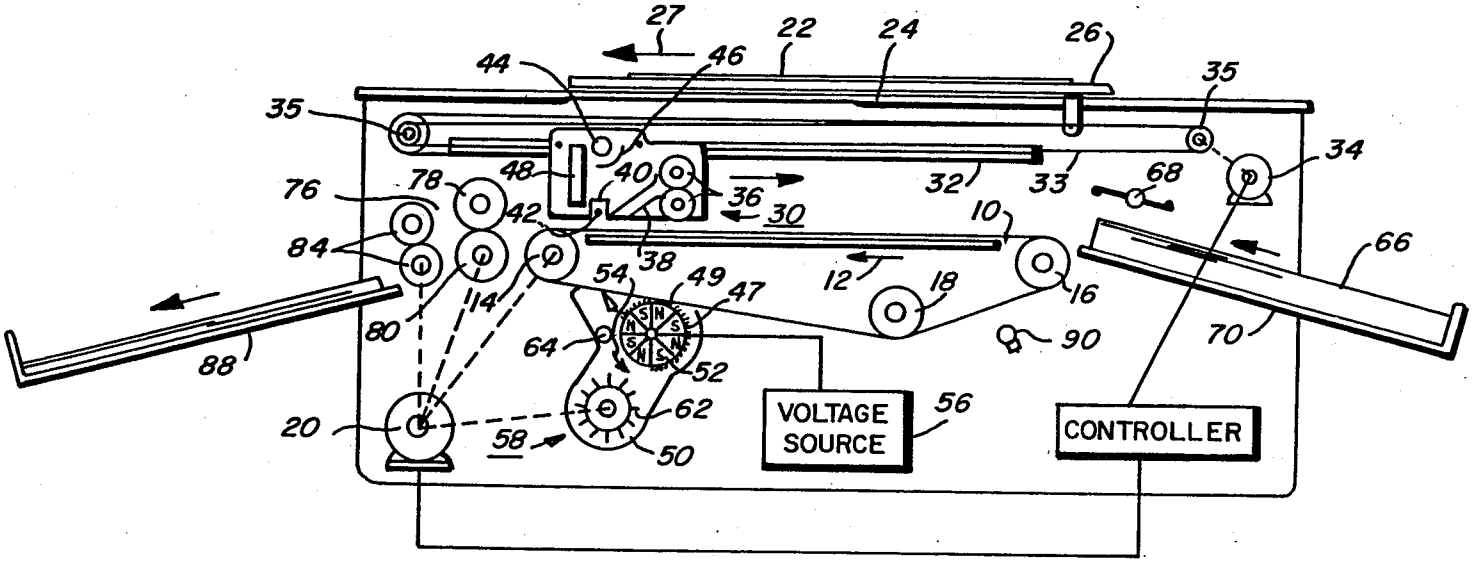
FIG. 1 is a schematic representation in cross section of an electrostatographic reproducing machine with the optical scanning module according to the present invention.

The invention will now be described with reference to a preferred embodiment of the electrostatographic reproducing apparatus according to the present invention.

The drawings schematically depict the various components of the electrostatographic reproducing machine incorporating the features of the present invention therein. In the drawings and specification like reference numerals have been used throughout the designated identical elements. It will become evident from the following discussion that these features are equally suited for use in a wide variety of electrostatographic reproducing machines and are not necessarily limited in their applications to particular embodiments depicted herein.

Referring now to FIG. 1, as shown in the drawing, the electrophotographic printing machine employs a belt 10 having a photoconductive surface deposited on a conductive substrate. Preferably, the photoconductive surface is made from an organic photoconductor with the conductive substrate being made from an aluminum alloy. Belt 10 moves in the direction of arrow 12 to advance successive portions of the photoconductive surface through the various processing stations disposed about the path of movement thereof. Rollers 14, 16 and 18 maintain belt 10 under suitable tension. Roller 14 is coupled to drive motor 20. Rollers 16 and 18 are mounted in suitable bearings to rotate freely and act as idler rollers. Motor 20 drives roller 14 to advance belt 10 in the direction of arrow 12.

An original document 22 is disposed facedown upon a transparent platen 24. Platen 24 is mounted in a frame 26 which is capable of reciprocating motion in a horizontal direction, as indicated by arrow 27. Belt 10 moves in a recirculating path. In order to reproduce a copy of an original document, belt 10 performs two complete cycles of movement through the recirculating path.

During the first cycle the belt is uniformly charged, exposed to a document to be reproduced on the platen and the resulting electrostatic latent image developed, with charged toner particles at combined developing/-cleaning unit 50. In the second cycle, the toner image now present on the photoconductive belt in image configuration is transferred to copy paper and the belt once again returned to combined developing/cleaning unit 50 where it is cleaned of residual toner in preparation for the next imaging cycle. As illustrated in FIG. 1, during the imaging sequence the platen scans to the left as the belt is also advanced to the left while the optics module 30 moves to the right toward an end of scan position. During the first cycle as the belt 10 advances, successive portions of the photoconductive surface beneath the optics module which is advanced in the scanning direction to the right, is charged by corona generating device 42 positioned within a U-shaped shield 40 having an open end opposed from the photoconductive surface of belt 10. The corona generating device uniformly charges the surface of the belt to relatively high potential. Immediately following uniform charging by the corona generating device 42, the belt is exposed to the successive incremental portions of the image of the original document on the viewing platen as the viewing platen is moved to the left by means of light source 44 such as an elongated tungsten lamp and reflector 46 so that the light rays from the light source 44 are projected onto the original document 22 disposed face down on the transparent platen 24 as the platen 24 moves in the direction of arrow 27. Light rays reflected from original document 22 are transmitted to a bundle of transmitting fibers indicated generally by the reference numeral 48. Image transmitting fibers 48 are bundled gradient index optical fibers such as those described in U.S. Pat. No. 3,658,407 issued to Kitano et al. in 1972. Kitano et al. describes a light conducting fiber made of glass or synthetic resin which has a refractive index distribution in cross section thereof that varies consecutively and parabolically outwardly from a center portion thereof. Each fiber acts as a focusing lens to transmit part of an image placed at, or near, one end thereof. An assembly of fibers, in a staggered two-row array transmits and focuses a complete image of the object. The fiber lenses are produced under the tradename "SELFOC"; the mark is registered in Japan and owned by Nippon Sheet Glass Company, Limited. These gradient index lens arrays are used as a replacement for conventional optical systems in electrophotographic printing machines, such as being disclosed in U.S. Pat. No. 3,947,106 issued to Hamaguchi et al., in 1976 and U.S. Pat. No. 3,977,777 issued to Tanaka et al. in 1976. The relevant portions of the foregoing patents are hereby incorporated into the present disclosure. The light rays reflected from the original document are transmitted through the image transmitting fibers onto the charged portions of the photoconductive surface of belt 10 to selectively dissipate the charge thereon. This records an electrostatic latent image on the photoconductive surface of belt 10 which corresponds to the informational areas contained within original document 22.

Therefore, belt 10 advances the electrostatic latent image recorded on the photoconductive surface to a combined developing/cleaning unit, indicated generally by the reference numeral 50. Combined developing/cleaning unit 50 includes a developer roller, indicated generally by the reference numeral 47. Developer roller 47 comprises an elongated cylindrical magnet 52 stationarily mounted interiorally of tubular member 49. Tubular member 49 rotates in the direction of arrow 54. Voltage source 56 is electrically connected to tubular member 49 so as to electrically bias tubular member 49 to a potential ranging from about 50 volts to about 500 volts. A specific selected voltage level depends upon the potential level of the latent image and that of the background areas. During development, the biasing voltage is intermediate that of the background and latent image. Conveyor 58 which comprises a cylindrical member 60 having a plurality of buckets 62 thereon advances developer material comprising magnetic carrier granules having toner particles adhering triboelectrically thereto upwardly to developer roller 49. Developer roller 49 attracts the developer material thereto. As tubular member 49 rotates in the direction of arrow 54, the developer material is transported into contact with the latent image and toner particles are attracted from the carrier granules thereto. In this way, a toner powder image is formed on the photoconductive surface of the belt 10. Auger 64 mixes the toner particles with the carrier granules. Preferably, tubular member 49 is made from a non-magnetic material such as aluminum having the exterior circumferential surface thereof roughened. Magnetic member 52 is made preferably from barrium ferrite having a plurality of magnetic poles impressed thereon. A metering blade, not shown, may be employed to define a gap between tubular member 49 through which the developer material passes. This gap regulates the quantity of developer material being transported into contact with the electrostatic latent image recorded on the photoconductive surface of belt 10. A developed image on the photoconductive belt is now ready to be transported to transfer station wherein it can be transferred to a copy sheet.

Figure 2:
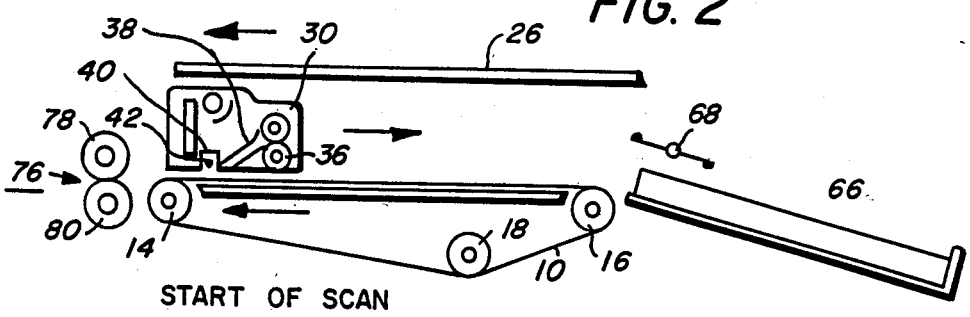
FIG. 2 is an enlarged cross section of the apparatus according to the present invention operated in a preferred manner wherein the optical scanning module is in the start of scan position and the viewing platen is in the home position.
Figure 3:
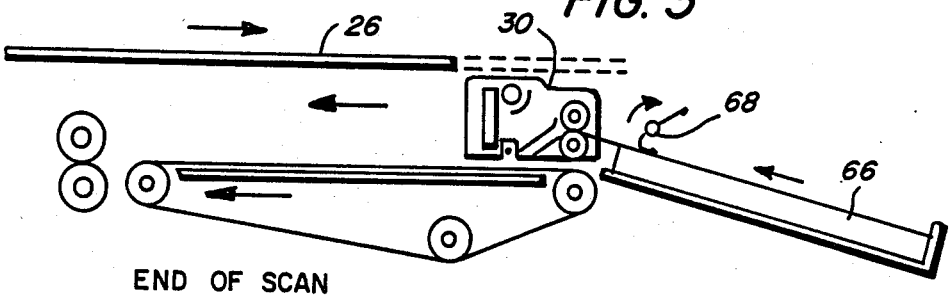
FIG. 3 is an enlarged cross section of the preferred embodiment illustrated in FIG. 2 wherein the optical scanning carriage is at the end of scan position, the viewing platen is also at the end of scan position and the registration rolls in the optical scanning carriage has captured a copy sheet.
Figure 4:
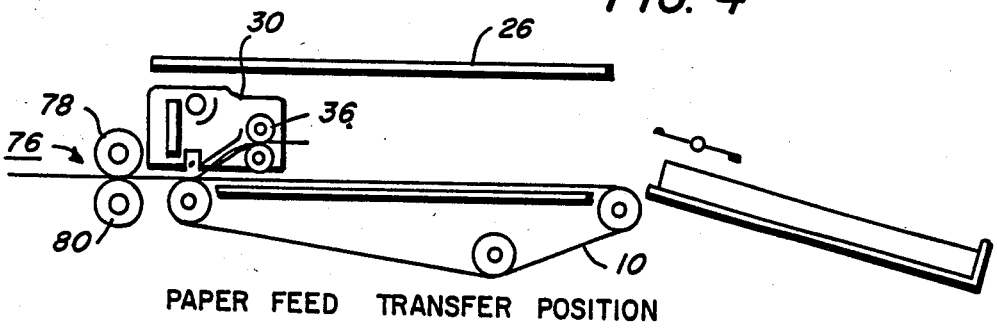
FIG. 4 is an enlarged view of a preferred embodiment according to the present invention wherein the optical scanning carriage has returned to the transfer position, the viewing platen has returned to the home position and the copy sheet captured by the optical scanning module is fed in timed relation with the image on the photoconductive belt for transfer of the toner image.

With continued reference to FIG. 1 and additional reference to FIGS. 2, 3 and 4 illustrating a preferred embodiment of the present invention, the function of the scanning optics module will be described in greater detail.

As illustrated in FIGS. 1 and 2 with scanning optics module in the start of scan position, when the machine is activated simultaneously the photoconductive belt 10 is driven around rollers 14, 16, 18 in the manner previously indicated and moving platen 24 fastened to the top run of drive belt 33 is driven in the direction of arrow 27 between pulleys 35. Simultaneously therewith optics module 30 positioned on optics module carriage 32 and fastened to the lower run of drive belt 33 is driven between pulleys 35 by motor 34 in a recriprocating fashion. Initially the optics module is driven to the right in the direction opposite to the direction of transport of the photoconductive belt and the viewing platen containing the document thereon to be reproduced. As the optics scanning module travels relative to the photoconductive belt, it charges successive incremental portions initially followed almost immediately by exposing successive incremental portions of the original document on the scanning platen onto the moving belt. In the preferred embodiment illustrated in FIGS. 2, 3 and 4, a viewing platen 24 transports the document 22 to the left at a given speed. The scanning optics module is driven to the right at the same given speed. If the photoconductive belt is now driven to the left in the direction indicated in FIG. 2 at twice the given speed successive incremental portions of the document to be reproduced on the platen remain stationary relative to the successive incremental portions of the photoconductive belt which are imaged. Accordingly a faithful reproduction of the document to be reproduced may be obtained on the belt.

FIG. 3 illustrates the optical scanning module 30 the end of scan position with the viewing platen also being to the left in the end of scan position. When the optics module is in the end of scan position, the paper feeder 68 is activated and a copy sheet 66 is advanced from the tray toward the registration rolls 36 in the scanning optics module. Preferably sheet feeder 68 includes a rotatably mounted cylinder having a plurality of spaced flexible vanes extending outwardly therefrom, the free end of each vane successively engages the uppermost sheet 66 of stack 70. Simultaneously with the activation of the sheet feeder, registration rolls 36 in the scanning optics module are activated to at least capture within their nip the lead edge of the first sheet 66 of copy paper being fed by the paper feeder. Once the lead edge of the copy sheet 66 is captured in the nip of the registration rolls 36, the viewing platen 24 may be returned to its start of scan or home position respectively by movement in the direction of the arrows indicated in FIG. 3. Simultaneously the scanning optics module is driven to the transfer position in the direction indicated in FIG. 3.

Simultaneously with the scanning optics module acquiring the top sheet in a stack of sheets of copy paper, the remaining successive portions of the imaged photoconductive belt are continued to be developed at the developing/cleaning unit 50 in the manner previously described. When the scanning optics module returns to the paper feed and transfer position as indicated in FIG. 4, the registration rolls 36 are once again activated and the copy sheets 66 are fed forward through the feed chute 38 so that the lead edge thereof meets with the lead edge of the toner image on the photoconductive belt in timed relation thereto. The registration rolls 36 feed the copy sheets to the transfer position at the same speed the photoconductive belt is transported through the transfer position. Furthermore as further illustrated with regard to FIG. 4, the copy sheet 66 being fed by registration rolls 36 contacts the photoconductive belt just prior to the belt turning around roller 14 to provide a small transfer zone. The backside of the copy sheet in contact with the photoconductive belt is sprayed with ions by the corona generating device 42 which attracts the toner powder image from the photoconductive surface of belt 10 to the copy sheet. After transfer the sheet moves a very short distance with the belt 10 until the beam strength of the sheet causes it to strip therefrom as the belt passes around roller 14. As the sheet separates from the belt 10 it advances to a fuser assembly indicated generally by reference numeral 76 which includes roller 78 and 80. The sheet passes between the roller 78 and 80 which apply pressure thereon to permanently affix the toner powder image to the copy sheet. Thereafter exit rollers 84 advance the sheet in the direction of arrow 86 onto a catch tray 88 for subsequent removal from the copying machine by the operator. It should be noted that once the trail edge of the copy sheet 66 passes through the transfer zone that the reproducing apparatus is immediately capable of operating in the next copying cycle since a clean incremental segment of photoconductive belt 10 is immediately adjacent to the corona generating device and the optical system. The scanning optical module may now be moved to the start of scan position indicated in FIG. 2.

Following transfer of the toner image to the copy sheet 66 the photoconductive belt may contain some residual toner particles that have not transferred to the copy sheet. These are removed by the combined developing/cleaning unit previously described during the second cycle of the photoconductive belt through that apparatus. During the second cycle the voltage source 56 electrically biases tubular member 49 to a potential greater than that of the latent image. Thus during cleaning voltage source 56 electrically biases tubular member 49 to a potential having a magnitude greater than the developing potential of the first cycle. In this way the toner particles are attracted to the carrier granules adhering to tubular member 49. Thus the residual toner particles are removed from the photoconductive surface and returned to the combined developing/cleaning unit for subsequent use.

After the residual toner particles have been cleaned from the photoconductive surface belt 10 any residual charge remaining on the photoconductive surface may be removed by illuminating the photoconductive surface with light rays from a light source 90 (see FIG. 1).

Briefly recapping the operation of the preferred embodiments illustrated in the Figures starting with FIG. 2, scanning optics module is initially at rest in the start of scan position to the left of the viewing platen and the copy selector is activated. Simultaneously the scanning optics module is driven to the right at a given speed while the viewing platen is driven to the left at the same given speed while the photoconductive belt, which is spaced from and parallel to the viewing platen, is driven to the left at twice the given speed. During the scanning function the relative speeds enable the viewing platen and therefore any document thereon to be stationary relative to the moving photoconductive belt 10. After the whole document has been scanned, the optics module comes to rest at the end of scan position illustrated in FIG. 3, while the viewing platen also comes to rest at the end of scan position. At this time the image portion of the photoconductive belt should be passing through a combined developing/cleaning unit for developing the electrostatic latent image thus formed. With the scanning optics module in the end of scan position, the paper feeder is activated, the top copy sheet in the stack is fed forward to registration rolls which acquire at least the lead edge of the copy paper in the nip formed between the rolls. Once the copy sheet has been acquired by the scanning optics module the optics module once again is driven to the left to the paper feed and transfer position while the viewing platen is returned to the right to the home position. The registration rolls now act as copy sheet feed rolls, they are activated and the lead edge of the copy sheet is fed synchronized with the lead edge of the developed image on the photoconductive belt. In this position the corona generating device in the scanning optics module acts as a transfer corotron and the image is transferred to the copy paper which is subsequently fed out to the fuser. When the trail edge of the copy sheet passes through the transfer position the optics module may be returned to the start of scan position.

While the preferred embodiment described above refers to the viewing platen and the scanning optics module as being driven in opposite directions at the same speed as the photoconductive belt is driven at twice the speed in the direction of the viewing platen, it will be understood that the speeds of the viewing platen and scanning optics module may be altered such that during the scanning/imaging function the relative speeds of the successive incremental portions of the document on the platen to be reproduced remain stationary relative to the successive incremental portions of the photoconductive belt which are imaged. In this regard with the photoconductive belt moving at speed X and the optics module, for example, moving at a speed of Y (Y being less than X), the platen speed would be X−Y. All that is necessary to maintain the relationship is for the scan of the optics speed and platen speed to equal the speed of the photoconductive belt.

Figure 5:
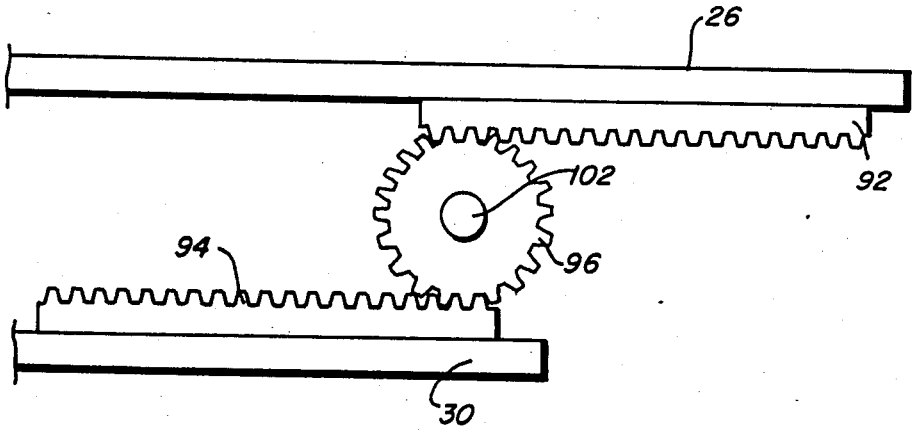
FIGS. 5 and 6 illustrate alternative embodiments of drive mechanisms used to drive the optical scanning carriage and the viewing platen.
Figure 6:
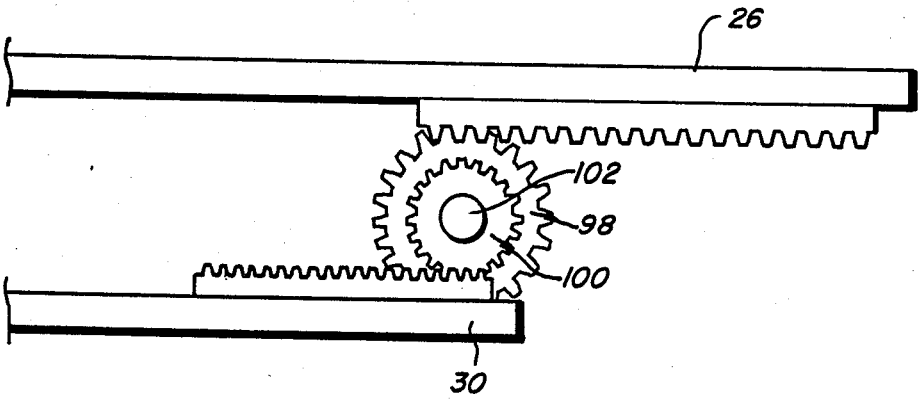

FIGS. 5 and 6 represent alternative platen and scanning optics drive mechanisms to the belt mechanism generally illustrated in FIG. 1. In FIG. 5 a mechanism is illustrated where the platen and the scanning optics module are driven at the same speed in different directions. As stationary pinion gear 96 driven by any suitable means such as motor 34 rotates counterclockwise, it drives rack 92 fastened to platen frame 26 to the left and simultaneously drives the optics module 30 to the right through rack 94 fastened to the optics module. Similarly in FIG. 6 with the use of a large pinion gear 98 driving the platen frame 26 and a small pinion gear 100 mounted on the same shaft 102 driving the optics module to the right, the relative speeds of the two components may be adjusted as desired. As illustrated the platen has a greater speed than the optics module.

The drive mechanism for the individual components in the illustrated machine configuration have been illustrated generally with respect to individual motors for driving the scanning optics assembly, the photoconductive belt and the viewing platen through means of a suitable controller. It will be understood that the specific drive mechanism does not form a part of the present invention and that it may be accomplished in any of well known manners available in the art. It is important that the belt, platen and optics module be driven in timed relationship to acquire the necessary synchronization during the imaging and the transfer operation.

Thus according to the present invention a novel electrostatographic reproducing apparatus has been provided. Furthermore a reproducing apparatus wherein there is a relative short transfer zone insuring maximum transfer efficiency has been provided. In addition, the apparatus as described has an improved copy rate without increase in platen speed. Furthermore with the top paper path indicated in the disclosed apparatus it has the capability of providing a reproduction of a set of documents from the first sheet to the end sheet and collecting collated reproduced copies of these documents in the first to end sheet orientation without the use of an inverter.

The disclosures of the patents referred to herein are hereby specifically and totally incorporated herein by reference.

While the invention has been described with reference to a specific embodiment thereof it will be apparent to those skilled in the art that many alternatives, modifications and variations may be made. For example, while the apparatus has been indicated in the preferred embodiment as producing a one to one reproduction of the original document on the viewing platen it will be appreciated that by altering the various speeds of the viewing platen, scanning optics assembly and photoconductive belt that other magnifications of the image on the viewing platen in the scanning direction may be obtained. Accordingly it is intended to embrace all such alternatives, and modifications as may fall within the spirit and scope of the appended claims.

What is claimed is:

1. An electrostatographic reproducing apparatus comprising a transparent viewing platen for supporting a document thereon to be reproduced, a photoconductive belt positioned below said viewing platen arranged to move in a recirculating path completing two cycles for each copy produced, an optical scanning module positioned between said viewing platen and said photoconductive belt including means for scanning said viewing platen from a start of scan to an end of scan position to reproduce an image of a document on said platen on said photoconductive belt, means to develop said image with charged toner particles on said photoconductive belt, said optical scanning module futher including copy sheet registration rolls, a copy sheet feeder at the end of scan position, means to actuate said copy sheet feeder to feed a copy sheet to said registration rolls when said optical scanning module is at the end of scan position, means to activate said registration rolls to capture at least the lead edge of said copy sheet, means to return said optical scanning module to the start of scan position, means to feed the lead edge of said copy sheet in said optical module in timed relation and into contact with the lead edge of said toner image on said photoconductive belt, and means to transfer said toner image from said belt to said copy sheet.

2. The reproducing apparatus of claim 1, wherein said photoconductive belt has a portion of its path spaced from and parallel to said viewing platen.

3. The reproducing apparatus of claim 1, wherein said optical scanning module further includes a combined charge/transfer corona generating device for uniformly charging the photoconductive belt prior to imaging and subsequently to electrostatically transfer the charged toner particles in the developed image on the photoconductive belt to the copy sheet.

4. The reproducing apparatus of claim 3, wherein said optical scanning module further includes a source to illuminate a document on the platen to be reproduced and means to focus a light image of the document onto the charged portion of said photoconductive belt, said focusing means, corona generating device and copy sheet registration rolls being arranged in that order in said module in the scanning direction.

5. The reproducing apparatus of claim 1, further including means to move said viewing platen and said photoconductive belt when said optical module scans said viewing platen.

6. The reproducing apparatus of claim 5, wherein during imaging said optical module scans in the scanning direction, said platen moves in a direction opposite the scanning direction and said photoconductive belt moves in a direction opposite the scanning direction at a given speed the combined speeds of said platen and said optical module being equal to said given speed whereby said imaging platen and said photoconductive belt do not move relative to one another during imaging.

7. The reproducing apparatus of claim 5, wherein during imaging said optical module scans in the scanning direction at a given speed, said platen moves in a direction opposite the scanning direction at the same given speed and said photoconductive belt moves in a direction opposite the scanning direction at twice the given speed whereby said imaging platen and said photoconductive belt do not move relative to one another during imaging.

8. The reproducing apparatus of claim 1, wherein said means to develop said image on said belt comprises a combination developing/cleaning unit and wherein said belt is uniformly charged, exposed to the original on the viewing platen and developed with charged toner particles during the first cycle with the toner image being transferred to the copy sheet and the photoconductive belt being cleaned of residual toner during the second cycle of the belt.

9. The reproducing apparatus of claim 5, wherin sid photoconductive belt is supported between two support rolls one each near the start of and end of scan positions and wherein the copy sheet is fed into timed relation with the photoconductive belt to transfer the toner around the belt support roll near the start of scan position thereby providing a short toner transfer zone.

10. The reproducing apparatus of claim 1 wherein said combination developing/cleaning unit includes a rotatably mounted tubular member and a magnetic member mounted stationarily interiorly of and spaced from said tubular member.

11. The reproducing apparatus of claim 1, wherein said means to develop said image on said belt comprises a combination developing/cleaning unit positioned adjacent the portion of the recirculating photoconductive belt path that is not below said viewing platen.

12. An optical scanning module for use in an electrostatographic reproducing apparatus to scan, in the scanning direction, a document to be reproduced, said module comprising a light source to illuminate a document, means to focus a light image of a document, a corona generating device and copy sheet registration means, said focusing means, corona generating device and copy sheet registration means being arranged in the stated order in said module toward the scanning direction.

13. The optical scanning module of claim 12, wherein said copy sheet registration means comprises a pair of registration feed rolls in communication with a sheet feed chute to direct a copy sheet, when fed by said rolls, under the corona generating device.

14. The optical scanning module of claim 12, wherein said focusing means comprises an array of light transmitting light conducting fibers arranged in an elongated bundle transverse to the direction of scanning.

* * * * *